United States Patent [19]

Mandel

[11] 4,102,437

[45] Jul. 25, 1978

[54] ELEVATOR SYSTEM

[75] Inventor: Alan F. Mandel, Pittsburgh, Pa.

[73] Assignee: Westinghouse Electric Corp., Pittsburgh, Pa.

[21] Appl. No.: 719,211

[22] Filed: Aug. 31, 1976

[51] Int. Cl.[2] ..... B66B 3/02

[52] U.S. Cl. ..... 187/29 R; 340/21

[58] Field of Search ..... 116/64; 187/29 R; 340/21

[56] References Cited

U.S. PATENT DOCUMENTS

| | | | |
|---|---|---|---|
| 2,903,093 | 9/1959 | Lusti | 187/29 R |
| 3,080,946 | 3/1963 | Dinning | 187/29 R |
| 3,370,676 | 2/1968 | McDonald | 187/29 R |

*Primary Examiner*—Robert K. Schaefer
*Assistant Examiner*—William L. Feeney
*Attorney, Agent, or Firm*—D. R. Lackey

[57] ABSTRACT

An elevator system including an elevator car mounted for movement in a structure to serve the floors therein, and a car position indicator for displaying the position of the car in the structure. The car position indicator displays the car position according to a first mode during normal system operation, and, in response to the car becoming disabled, it switches to a second display mode which more accurately indicates the position of the elevator car relative to the floors of the structure.

10 Claims, 4 Drawing Figures

| PROM INPUT | | | | | PROM OUTPUT/DECODER INPUT | | | | | | | | DISPLAY |
|---|---|---|---|---|---|---|---|---|---|---|---|---|---|
| AVP4 | | | | AVP0 | LEFT DIGIT | | | | RIGHT DIGIT | | | | |
| 1 | 1 | 1 | 1 | 1 | 1 | 1 | 0 | 0 | 1 | 0 | 1 | 1 | 24 |
| 1 | 1 | 1 | 1 | 0 | 0 | 0 | 1 | 1 | 0 | 0 | 0 | 0 | 30 |
| 1 | 1 | 1 | 0 | 1 | 0 | 0 | 1 | 0 | 1 | 0 | 0 | 1 | 29 |
| 1 | 1 | 1 | 0 | 0 | 0 | 0 | 1 | 0 | 1 | 0 | 0 | 0 | 28 |
| 1 | 1 | 0 | 1 | 1 | 0 | 0 | 1 | 0 | 0 | 1 | 1 | 1 | 27 |
| 1 | 1 | 0 | 1 | 0 | 0 | 0 | 1 | 0 | 0 | 1 | 1 | 0 | 26 |
| 1 | 1 | 0 | 0 | 1 | 0 | 0 | 1 | 0 | 0 | 1 | 0 | 1 | 25 |
| 1 | 1 | 0 | 0 | 0 | 0 | 0 | 1 | 0 | 0 | 1 | 0 | 0 | 24 |
| 1 | 0 | 1 | 1 | 1 | 0 | 0 | 1 | 0 | 0 | 0 | 1 | 1 | 23 |
| 1 | 0 | 1 | 1 | 0 | 0 | 0 | 1 | 0 | 0 | 0 | 1 | 0 | 22 |
| 1 | 0 | 1 | 0 | 1 | 0 | 0 | 1 | 0 | 0 | 0 | 0 | 1 | 21 |
| 1 | 0 | 1 | 0 | 0 | 0 | 0 | 1 | 0 | 0 | 0 | 0 | 0 | 20 |
| 1 | 0 | 0 | 1 | 1 | 1 | 1 | 1 | 0 | 1 | 1 | 1 | 0 | -- -- |
| 1 | 0 | 0 | 1 | 0 | 1 | 1 | 1 | 0 | 1 | 1 | 1 | 0 | -- -- |
| 1 | 0 | 0 | 0 | 1 | 1 | 1 | 1 | 0 | 1 | 1 | 1 | 0 | -- -- |
| 1 | 0 | 0 | 0 | 0 | 1 | 1 | 1 | 0 | 1 | 1 | 1 | 0 | -- -- |
| 0 | 1 | 1 | 1 | 1 | 1 | 1 | 1 | 0 | 1 | 1 | 1 | 0 | -- -- |
| 0 | 1 | 1 | 1 | 0 | 1 | 1 | 1 | 0 | 1 | 1 | 1 | 0 | -- -- |
| 0 | 1 | 1 | 0 | 1 | 1 | 1 | 1 | 0 | 1 | 1 | 1 | 0 | -- -- |
| 0 | 1 | 1 | 0 | 0 | 1 | 1 | 1 | 0 | 1 | 1 | 1 | 0 | -- -- |
| 0 | 1 | 0 | 1 | 1 | 1 | 1 | 1 | 0 | 1 | 1 | 1 | 0 | -- -- |
| 0 | 1 | 0 | 1 | 0 | 1 | 1 | 1 | 0 | 1 | 1 | 1 | 0 | -- -- |
| 0 | 1 | 0 | 0 | 1 | 1 | 1 | 1 | 0 | 1 | 1 | 1 | 0 | -- -- |
| 0 | 1 | 0 | 0 | 0 | 1 | 1 | 1 | 0 | 1 | 1 | 1 | 0 | -- -- |
| 0 | 0 | 1 | 1 | 1 | 1 | 1 | 1 | 0 | 1 | 1 | 1 | 0 | -- -- |
| 0 | 0 | 1 | 1 | 0 | 1 | 1 | 1 | 0 | 1 | 1 | 1 | 0 | -- -- |
| 0 | 0 | 1 | 0 | 1 | 1 | 1 | 1 | 0 | 1 | 1 | 1 | 0 | -- -- |
| 0 | 0 | 1 | 0 | 0 | 1 | 1 | 1 | 0 | 1 | 1 | 1 | 0 | -- -- |
| 0 | 0 | 0 | 1 | 1 | 1 | 1 | 1 | 0 | 1 | 1 | 1 | 0 | -- -- |
| 0 | 0 | 0 | 1 | 0 | 1 | 1 | 1 | 0 | 1 | 1 | 1 | 0 | -- -- |
| 0 | 0 | 0 | 0 | 1 | 1 | 1 | 1 | 1 | 0 | 0 | 0 | 1 | 1 |
| 0 | 0 | 0 | 0 | 0 | 1 | 1 | 1 | 1 | 0 | 0 | 0 | 1 | 1 |

FIG.3

| PROM INPUT | | | | | PROM OUTPUT/DECODER INPUT | | | | | | | | DISPLAY |
|---|---|---|---|---|---|---|---|---|---|---|---|---|---|
| AVP4 | | | | AVP0 | LEFT DIGIT | | | | RIGHT DIGIT | | | | |
| 1 | 1 | 1 | 1 | 1 | 1 | 1 | 0 | 0 | 1 | 0 | 1 | 1 | F H |
| 1 | 1 | 1 | 1 | 0 | 0 | 0 | 1 | 1 | 0 | 0 | 0 | 0 | 3 0 |
| 1 | 1 | 1 | 0 | 1 | 0 | 0 | 1 | 0 | 1 | 0 | 0 | 1 | 2 9 |
| 1 | 1 | 1 | 0 | 0 | 0 | 0 | 1 | 0 | 1 | 0 | 0 | 0 | 2 8 |
| 1 | 1 | 0 | 1 | 1 | 0 | 0 | 1 | 0 | 0 | 1 | 1 | 1 | 2 7 |
| 1 | 1 | 0 | 1 | 0 | 0 | 0 | 1 | 0 | 0 | 1 | 1 | 0 | 2 6 |
| 1 | 1 | 0 | 0 | 1 | 0 | 0 | 1 | 0 | 0 | 1 | 0 | 1 | 2 5 |
| 1 | 1 | 0 | 0 | 0 | 0 | 0 | 1 | 0 | 0 | 1 | 0 | 0 | 2 4 |
| 1 | 0 | 1 | 1 | 1 | 0 | 0 | 1 | 0 | 0 | 0 | 1 | 1 | 2 3 |
| 1 | 0 | 1 | 1 | 0 | 0 | 0 | 1 | 0 | 0 | 0 | 1 | 0 | 2 2 |
| 1 | 0 | 1 | 0 | 1 | 0 | 0 | 1 | 0 | 0 | 0 | 0 | 1 | 2 1 |
| 1 | 0 | 1 | 0 | 0 | 0 | 0 | 1 | 0 | 0 | 0 | 0 | 0 | 2 0 |
| 1 | 0 | 0 | 1 | 1 | 0 | 0 | 0 | 1 | 1 | 0 | 0 | 1 | 1 9 |
| 1 | 0 | 0 | 1 | 0 | 0 | 0 | 0 | 1 | 1 | 0 | 0 | 0 | 1 8 |
| 1 | 0 | 0 | 0 | 1 | 0 | 0 | 0 | 1 | 0 | 1 | 1 | 1 | 1 7 |
| 1 | 0 | 0 | 0 | 0 | 0 | 0 | 0 | 1 | 0 | 1 | 1 | 0 | 1 6 |
| 0 | 1 | 1 | 1 | 1 | 0 | 0 | 0 | 1 | 0 | 1 | 0 | 1 | 1 5 |
| 0 | 1 | 1 | 1 | 0 | 0 | 0 | 0 | 1 | 0 | 1 | 0 | 0 | 1 4 |
| 0 | 1 | 1 | 0 | 1 | 0 | 0 | 0 | 1 | 0 | 0 | 1 | 1 | 1 3 |
| 0 | 1 | 1 | 0 | 0 | 0 | 0 | 0 | 1 | 0 | 0 | 1 | 0 | 1 2 |
| 0 | 1 | 0 | 1 | 1 | 0 | 0 | 0 | 1 | 0 | 0 | 0 | 1 | 1 1 |
| 0 | 1 | 0 | 1 | 0 | 0 | 0 | 0 | 1 | 0 | 0 | 0 | 0 | 1 0 |
| 0 | 1 | 0 | 0 | 1 | 1 | 1 | 1 | 1 | 1 | 0 | 0 | 1 | 9 |
| 0 | 1 | 0 | 0 | 0 | 1 | 1 | 1 | 1 | 1 | 0 | 0 | 0 | 8 |
| 0 | 0 | 1 | 1 | 1 | 1 | 1 | 1 | 1 | 0 | 1 | 1 | 1 | 7 |
| 0 | 0 | 1 | 1 | 0 | 1 | 1 | 1 | 1 | 0 | 1 | 1 | 0 | 6 |
| 0 | 0 | 1 | 0 | 1 | 1 | 1 | 1 | 1 | 0 | 1 | 0 | 1 | 5 |
| 0 | 0 | 1 | 0 | 0 | 1 | 1 | 1 | 1 | 0 | 1 | 0 | 0 | 4 |
| 0 | 0 | 0 | 1 | 1 | 1 | 1 | 1 | 1 | 0 | 0 | 1 | 1 | 3 |
| 0 | 0 | 0 | 1 | 0 | 1 | 1 | 1 | 1 | 0 | 0 | 1 | 0 | 2 |
| 0 | 0 | 0 | 0 | 1 | 0 | 0 | 0 | 1 | 1 | 0 | 1 | 1 | 1 H |
| 0 | 0 | 0 | 0 | 0 | 0 | 0 | 0 | 1 | 1 | 0 | 1 | 0 | 1 L |

FIG.4

ELEVATOR SYSTEM

BACKGROUND OF THE INVENTION

1. Field of the Invention

The invention relates in general to elevator systems, and more specifically, to new and improved car position indicators for elevator systems.

2. Description of the Prior Art

Elevator systems conventionally provide a car position indicator in each elevator car to indicate to the passengers the position of the elevator car relative to the floors, and a car position indicator may also be located remotely from the car, at a selected floor, or floors, such as at a traffic director's station. The car position displayed on the position indicator is normally the advanced floor position of the car, i.e., the actual position of a stationary car, and the closest floor to the car at which the car could make a normal stop, for a moving car.

With an electromechanical floor selector, the car position indicator is driven by contacts actuated as the floor selector is driven in synchronism with the movement of the elevator car. U.S. Pat. No. 2,085,135 is an example of this type of position indicator. With a solid state floor selector, the advanced floor position may be developed by generating pulses responsive to car movement which are summed to proved a continuous car position, and this signal may be used to provide index pulses for an up-down counter which provides a car position signal related to a floor. U.S. Pat. No. 3,750,850 is an example of a floor selector which generates the advanced car position in this manner.

It is common in tall buildings to have banks of elevator cars which are enabled to serve only certain of the floors. This is usually a permanent arrangement, in which event there are no hoistway doors at the floors which the elevator car passes but which does not serve. When the elevator car is located in a zone of floors which it does not serve, which zone may include 10, 20, or more floors, the car position indicator for this car simply displays an "X", or other suitable symbol, to indicate the car is in an express zone.

It is also common for a structure or a building to have a more than normal spacing between certain of the floors, such as between the lobby floor and the next higher floor, due to a high ceiling in the lobby. The floor selector is constructed to accommodate different distances between the floors, and will usually display the floor number of the floor with the high ceiling as it is traversing the greater than normal floor-to-floor distance.

If an elevator car becomes disabled, there is no problem in quickly locating the car if it is adjacent a floor opening. However, the car may be stopped due to an emergency situation, in which event it may stop without regard to its position relative to a floor level. This may occur due to the operation of any one of many safety and monitoring devices in the elevator system, power failure, earthquake detection, or the like.

When an elevator car is disabled or stuck in the shaftway away from a floor opening, it is a difficult problem to quickly determine the position of the car so that it may be moved to the nearest landing, if possible, or at least to facilitate the evacuation of passengers from the car. The problem may be complicated by greater than normal floor-to-floor heights. If a car is disabled in the express zone of a building, the problem of locating the car becomes significantly more difficult. The express zone might cover a distance of 100, 200, or more feet.

In conventional elevator systems there is generally no easy method for determining the position of an elevator car in an express zone to within the less than 10 feet without entering the machine room. Even then, depending upon the type of floor selector in use, it can be both difficult and time consuming to determine the car position accurately. In the event of an emergency situation, such as an earthquake or a fire, it is extremely important to locate all disabled cars in a minimum amount of time. Also, during the emergency condition, access to the elevator machine room may not be possible. Thus, it would be highly desirable to have means for quickly locating any car which is disabled in the shaftway.

SUMMARY OF THE INVENTION

Briefly, the present invention is a new and improved elevator system in which the car position indicator in the elevator car, and/or a car position indicator at a location remote from the elevator car, has first and second modes of operation.

The first mode of operation is the normal mode, responding to a car position input signal to indicate, for example, an "X" when the car is in a zone of floors which it is not enabled to serve, and no attempt is made to indicate the position of an elevator car between two adjacent floors.

The second mode is an emergency mode in which the car position indicator, in response to the same car position input signal as in the first mode, more accurately displays the location of the car. For example, in this mode, when the car is disabled in an express zone, the car position indicator will display the floor number of the closest floor level in the express zone, notwithstanding the fact that there is no door opening for the car at this floor. Also, if there is a greater than normal distance between certain of the floors, the car position indicator, during the second mode, will indicate if the car is disabled in the lower or upper portion of this greater than normal floor-to-floor spacing.

Thus, in the case of a car disabled in the express zone, a car from the low rise bank of cars could be brought to that floor and a hole cut into the high-rise shaftway to quickly free the passengers. Even when the car is disabled during non-emergency building conditions, it would enable another car to be positioned on hand operation next to the stranded car to help free the passengers. Alternatively, maintenance personnel could move the car to the nearest floor landing.

The switching of the car position indicator from the normal or first mode to the emergency or second mode is automatically responsive to the car becoming disabled. The preferred implementation includes first and second read-only memories programmed to provide signals for displaying the car position during normal and emergency conditions, respectively. Disablement of the elevator car disables the first read-only memory and enables the second, which up to this point had been disabled. The building is divided into a plurality of binary addresses, according to the required accuracy of car location during the emergency. Thus, the car position address changes as the car proceeds through an express zone, but the first read-only memory is programmed to provide an "X" on the display for each of the express zone addresses. The second read-only memory, on the other hand, is programmed to provide floor numbers on the display for these express zone addresses.

In the event of greater than normal floor-to-floor distances, such as between the first and second floors, the first floor would be assigned more than one binary address, with the different addresses indicating the actual position of the car between the first and second floors. The first read-only memory is programmed to provide a "1" for each of the different addresses related to the first floor, while the second read-only memory is programmed to provide additional information such as 1L and 1H for the lower and upper positions of the car between the first and second floors.

BRIEF DESCRIPTION OF THE DRAWINGS

The invention may be better understood, and further advantages and uses thereof more readily apparent, when considered in view of the following detailed description of exemplary embodiments, taken with the accompanying drawings in which:

FIGS. 3 and 4 are graphs which illustrate the programming of read-only memories used in the car position indicator shown in FIG. 2.

DESCRIPTION OF PREFERRED EMBODIMENTS

Figure 1:
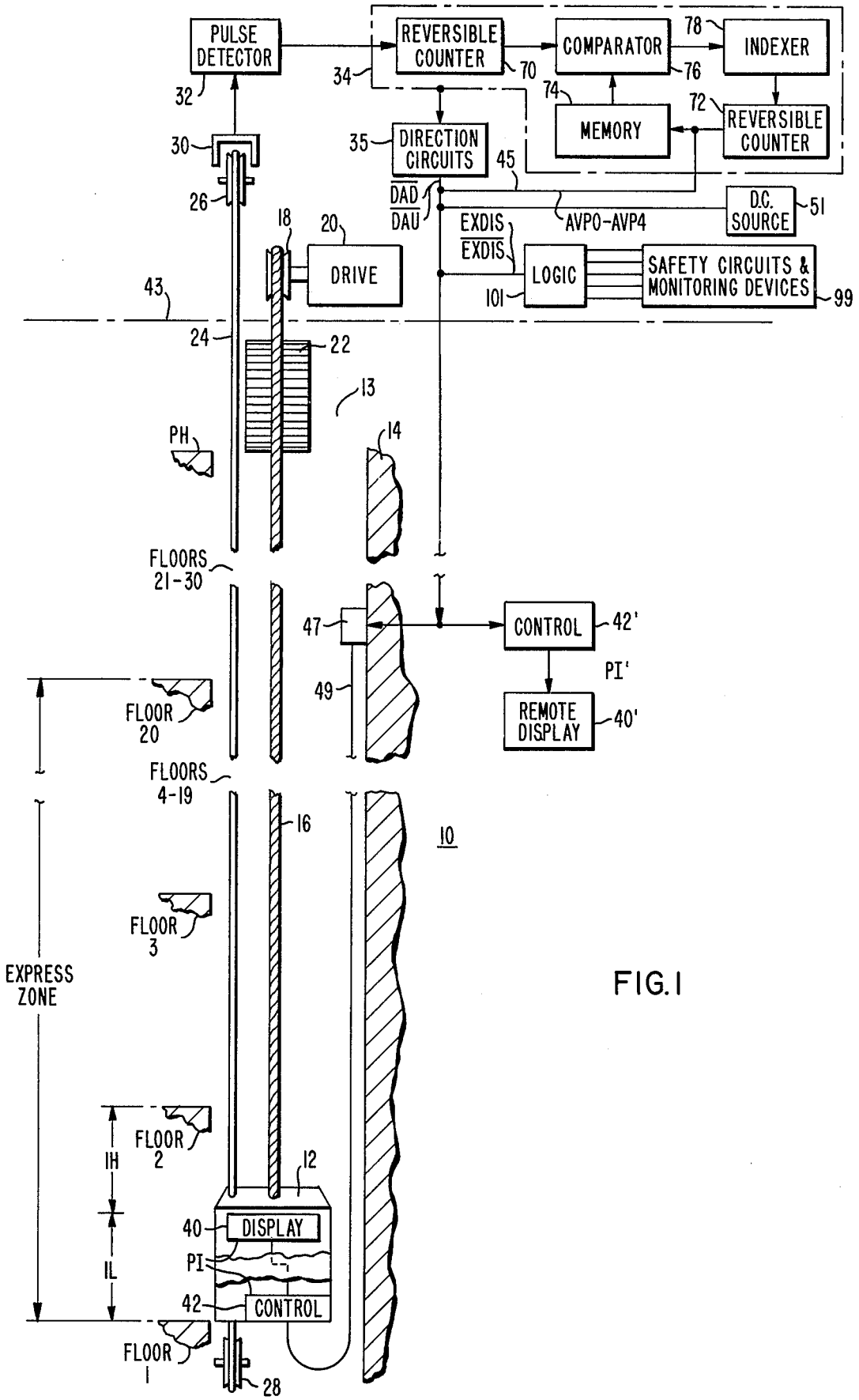
FIG. 1 is a partially schematic and partially block diagram illustrating an elevator system constructed according to the teachings of the invention.

Referring now to the drawings, and FIG. 1 in particular, there is shown an elevator system 10 which is constructed according to the teachings of the invention. Elevator system 10 includes an elevator car 12 mounted in the hoistway 13 for movement relative to a structure or building 14 having a plurality of floors or landings, with only a few of the floors being illustrated in order to simplify the drawing.

For purposes of example, it will be assumed that the structure 14 includes 31 floor levels, which includes a penthouse PH, and that the distance between the first and second floors is about twice the distance between the remaining floors. It will further be assumed that the elevator car 12 is unable to serve floors 2 through 19, and thus floors 2 through 19 form an express zone through which the elevator car proceeds at contract speed.

The car 12 is supported by a rope 16 which is reeved over a traction sheave 18 mounted on the shaft of a drive motor 20, such as a direct current motor having a solid state DC supply, or a motor-generator supply. A counterweight 22 is connected to the other end of the rope 16.

The elevator system 10 includes a car position indicator PI mounted in the elevator car 12, which includes a display 40 and associated control 42, and one or more additional car position indicators located remotely from the car, such as at a lobby floor and/or traffic director station. An additional car position indicator PI' remote from the car 12 is indicated in FIG. 1, with the car position indicator PI' including a display 40' and control 42'.

In the present invention, the advanced floor position of the elevator car is in the form of a binary signal. Binary addresses are also assigned, as required, to those building locations where a more accurate definition of car position is required. For up to and including 16 car positions, the position of the car may be represented by a 4 bit word; for up to and including 32 car positions, the car location requires a 5 bit word, etc.

If the car control includes a floor selector of the electromechanical relay type, a binary representation of the advanced position of the elevator car in the structure may be generated via a diode circuit board. If the car control is of the solid state type, a binary representation of the advanced position of the car in the structure may already be available. For example, U.S. Pat. No. 3,750,850, which is assigned to the same assignee as the present application, discloses a solid state floor selector which generates the advanced position as a binary signal AVP0-AVP4, and it will be assumed for purposes of example, that this solid state floor selector is providing the advanced position signal for the car position indicator of the present invention. While the car position signal is indicated as the advanced car position signal, if an actual car position signal is available, it may also be used in the present invention, at least to display the car position during the emergency display mode.

Using the same reference numerals in FIG. 1 which are used in U.S. Pat. No. 3,750,850 for indicating like components, the binary advanced floor position signal AVP0-AVP4 may be generated in a floor selector 34 via pulses generated in a pickup 30 responsive to openings disposed about the periphery of a governor sheave 26. A governor rope 24, which is connected to the top and bottom of the elevator car 12, is reeved over the governor sheave 26 located above the highest point of travel of the elevator car in the hoistway 13, and over a pulley 28 located at the bottom of the hoistway. Pickup 30 is disposed to detect movement of the elevator car 12 through the effect of circumferentially spaced openings in the governor sheave 26. The openings in the governor sheave are spaced to provide a pulse for each standard increment of travel of the elevator car, such as a pulse for each 0.5 inch (1.27 cm.) of car travel. Pickup 30, which may be of any suitable type, such as optical or magnetic, provides electrical pulses in response to the movement of the openings in the governor sheave. Pickup 30 is connected to a pulse detector 32 which provides distance pulses for floor selector 34. Distance pulses may also be developed in any other suitable manner, such as by a pickup disposed on the elevator car 12 which cooperates with regularly spaced indicia in the hoistway.

The floor selector 34 processes the distance pulses from the pulse detector 32 to develop information concerning the position of the car 12 in the hoistway 13. The floor selector 34 includes a reversible counter 70 which starts with a predetermined count at the lowest or first floor, counts up when the car is traveling upwardly, and counts down when the car is traveling downwardly. Counter 70 is a binary counter having the number of bits necessary to count to the binary number determined by the standard increment, and the height between the lowest and uppermost floors.

Counter 70 is arranged to output a binary number which continuously changes as the car moves relative to the structure, to continuously indicate the advanced car position, as opposed to the actual position of the car in the hoistway. This continuous advanced car position is the point at which the elevator car could be brought to a stop from its current velocity under a predetermined deceleration schedule. As disclosed in U.S. Pat.

No. 3,589,474, which is assigned to the same assignee as the present application, the continuous advanced car position may be generated directly in the reversible counter 70 by generating pulses at twice the rate of the distance pulses when the car is accelerating, and at the same rate as the distance pulses when the car is traveling at constant speed. When deceleration is initiated, the counting of the distance pulses is discontinued such that when the elevator car comes to a stop, the count in the counter reflects the actual car position.

A second reversible counter 72 provides a signal which indicates the discrete advanced car position in terms of car position to be displayed. The second reversible counter 72 is also a binary counter, having the number of bits necessary to provide a binary word for the maximum number of car positions to be displayed. Counter 72 is indexed up or down, as required, as the count of the continuous advanced car position changes.

A read-only memory 74 is provided, which, when addressed by the binary word of counter 72, which represents the discrete advanced position of the car, outputs a binary word having the number of bits necessary to describe the exact location of each car position to be displayed relative to the structure, with a resolution of the same standard increment used to generate the distance pulses. For example, a 5 bit binary input word describing a car position may cause memory 74 to output a 16 bit binary word describing the exact location of that particular car position in the structure.

A bit-by-bit comparator 76 is provided which compares the binary output words of counter 70 and memory 74. When the binary words of counter 70 and memory 74 are equal, comparator 76 outputs an equality signal. The equality signal indicates slowdown must be initiated at this time or the car cannot stop at the discrete advanced car position. If deceleration is not initiated at that point, comparator 76 provides a signal for indexer 78. Indexer 78 provides a signal for counter 72 which increments or decrements the counter 72 to output the binary word for the next car position to be displayed in the travel direction. It is this binary word of counter 72 whih is referred to as signal AVP0-AVP4, and it is connected to the control 42 in the elevator car 12. Since the floor selector 34 is located remote from the elevator car 12, such as in the machine room, indicated as being above broken line 43 in FIG. 1, the five wires of signal AVP0-AVP4, indicated generally by conductor 45, are connected to a junction box 47 located approximately at the midpoint of the car travel path, and the wires entering junction box 47 are connected to the elevator car 12 via a traveling cable 49.

Floor selector 34 provides signals for direction circuits 35, which circuits provide signals $\overline{DAD}$ and $\overline{DAU}$ which are also sent to the car position indicators PI and PI'.

In addition to control signals, a source 51 of direct current potential, such as +125 volts DC, located in the machine room, is connected to the elevator car 12 via the traveling cable 49 for operating the safety relays. An alternating current source (not shown) in the machine room is also connected to the elevator car for lighting and fan loads in the car.

The display 40, as well as any remotely located displays 40', operate in a normal or first mode to display the number 1, or the letter L for lobby, etc., for floor 1 shown in FIG. 1, regardless of the position of the elevator car between floor levels 1 and 2. Further, in the normal mode, when the elevator car is in the express zone, an "X" or other suitable symbol, is displayed, since the car will not have a hatch door opening for floors in its express zone. It would be misleading to display the express zone floor numbers when the car is unable to service those floors.

When the elevator car 12 becomes disabled, the display 40 is automatically switched by its control 42 to operate in a second or emergency mode, in which mode the position of the elevator car is more accurately displayed in order to quickly locate the position of the car in the structure.

The display 40 is preferably a solid state display, selected for its long operating life. While the invention is not limited to any specific type of display, the display is preferably of the field effect liquid crystal type, and it will be described as such.

The safety circuits and monitoring devices, which when operated may disable the car, are shown generally in FIG. 1 at 99. The outputs of the safety circuits and monitoring devices are connected to a logic circuit, shown generally at 101, which is operable between first and second conditions. Logic circuit 101 is in its first condition, providing signals EXDIS and $\overline{EXDIS}$ which are at the logic zero and logic one levels, respectively, when the elevator system 10 is operating normally. Logic circuit 101 is switched to a second condition in which signals EXDIS and $\overline{EXDIS}$ are at the logic one and logic zero levels, respectively, when any safety circuit or monitoring device 99 operates to disable the elevator car 12. Signals EXDIS and $\overline{EXDIS}$ are connected to the control 42 of the position indicator PI, and also to similar control 42' of any remotely located car position indicators. When signals EXDIS and $\overline{EXDIS}$ indicate normal operation, controls 42 and 42' respond in a first manner to the car position signal AVP0-AVP4, and when signals EXDIS and $\overline{EXDIS}$ indicate the car may be disabled, controls 42 and 42' respond differently to at least certain of the addresses provided by the car position signal AVP0-AVP4, to more accurately define the location of the elevator car 12 in the building.

Figure 2:
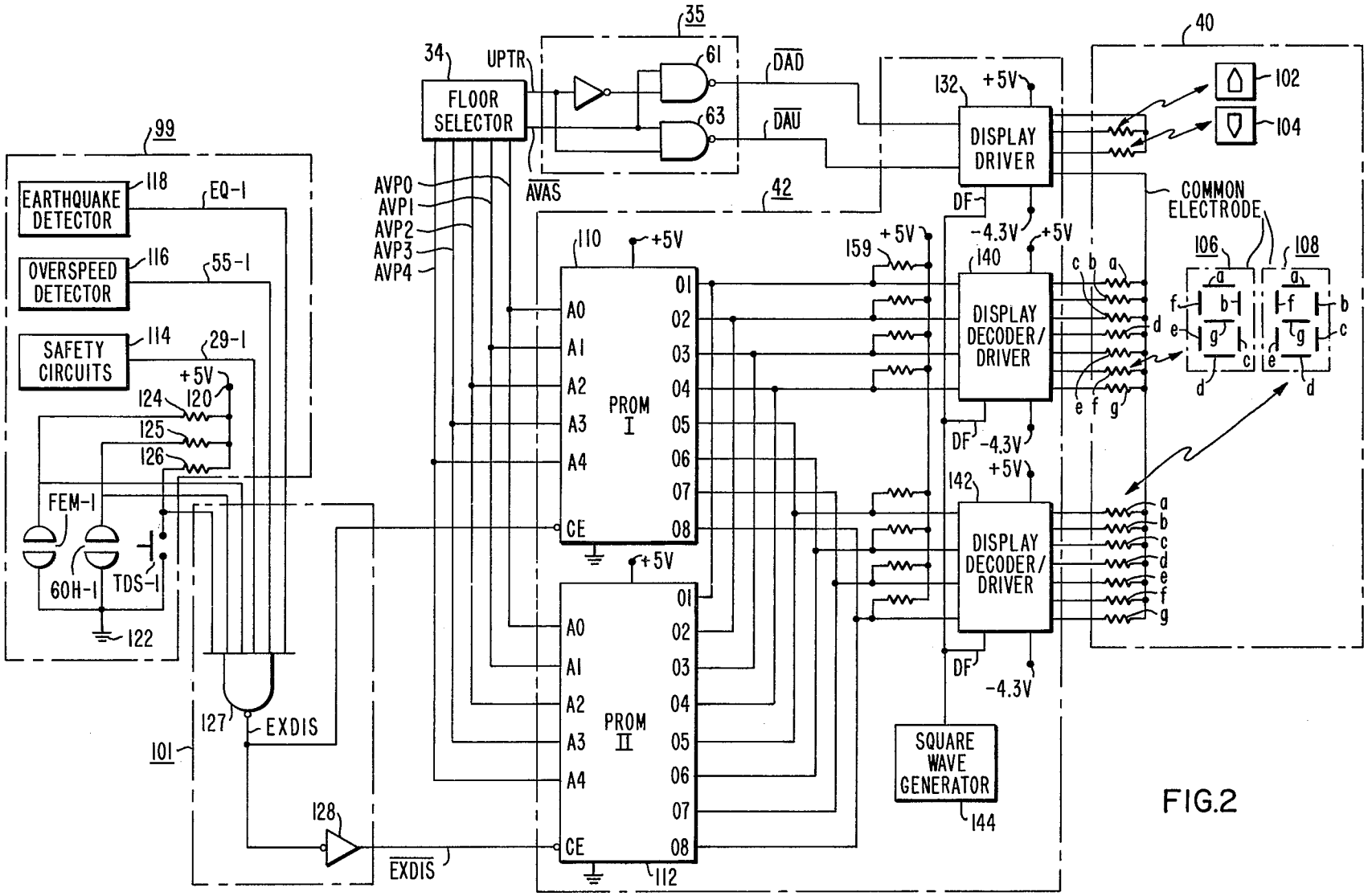
FIG. 2 is a schematic diagram which illustrates in detail certain portions of the elevator system shown in FIG. 1, as well as a car position indicator constructed according to the teachings of the invention.

FIG. 2 is a schematic diagram of an elevator system having a car position indicator constructed according to an embodiment of the invention. In addition to the floor selector 34 providing the advanced car position signal AVP0-AVP4, it provides signals UPTR and $\overline{AVAS}$. Signal UPTR is a logic one when the associated elevator car is set for up travel, and a logic zero when the elevator car is set for down travel. Signal $\overline{AVAS}$ is a logic zero when the car is in service and has no calls, and a logic one when the car is busy. These signals are combined in the direction circuits 35 which include NAND gates 61 and 63 to provide signals $\overline{DAD}$ and $\overline{DAU}$. Signal $\overline{DAD}$ is a logic zero when the car is busy and set for down travel, and signal $\overline{DAU}$ is a logic zero when the car is busy and set for up travel. These signals are sent to the elevator car 12 over the traveling cable 49 to operate the travel direction arrows of the car position indicator PI, and these signals are also sent to any remote position indicators.

Signals AVP0-AVP4 and $\overline{DAD}$ and $\overline{DAU}$ are logic voltage level signals in the penthouse, and they are changed to a power or higher voltage levels in a suitable interface for transmission to the elevator car 12. These higher voltage signals are then converted back to the logic voltage levels in a high voltage to logic level interface which is located in the elevator car 12. Since these interfaces may be conventional, they are not illustrated in order to simplify the drawing.

The display 40, in the example of FIG. 2, includes an up direction arrow 102, a down direction arrow 104, a left digit 106, and a right digit 108. The left and right digits are 7-segment display characters, with the 7 segments being referenced *a* through *g*. As hereinbefore stated, the display 40 is preferably of the field effect liquid crystal type, but other displays may be used, such as dynamic scattering liquid crystal displays, gas discharge displays, light emitting diode displays, and electrophoretic displays. Also, in an actual car position indicator a display character having more than 7 segments would probably be used in order to be able to form an "X" when the car is in an express zone. The principles of the invention are unchanged, however, by the number of segments in the display character, and a 7 segment character has been selected in order to simplify the drawing.

The power supply for a car mounted car position indicator may simply be a Zener diode/resistor power supply which drops the 125 volts DC available in the car to the desired voltage magnitude. This low cost power supply is made practical by the teachings of co-pending application Ser. No. 578,304, filed May 16, 1975, now U.S. Pat. No. 3,995,719 which application also discloses arrangements for standardizing the wiring of car position indicators.

The advanced car position binary signal AVP0-AVP4, developed in the floor selector 34, is connected to the inputs A0 through A4 of first and second programmable readonly memories 110 and 112, respectively, and the travel direction signals $\overline{DAU}$ and $\overline{DAD}$ are connected to a display decoder/driver 132.

The programmable read-only memories 110 and 112, hereinafter referred to as PROM I and PROM II, respectively, such as Intersil's IM5600, are programmed to provide the desired car position display for normal and emergency modes, respectively. The emergency mode, more accurately defines the car position in the structure relative to the floors, than is required in the normal mode.

The signals which select PROM I or PROM II are provided by safety circuits and monitoring devices 99 and logic circuit 101. The safety circuits and monitoring devices 99 may include the usual safety circuits which control a safety relay, shown generally at 114. The safety relay has a contact which controls the generation of a logic signal. When the safety circuits indicate everything being monitored is operating normally, the safety relay is energized and a contact thereof is used to provide a signal 29-1 at the logic one level. When signal 29-1 is a logic zero, it indicates a malfunction associated with one or more of the various functions monitored by the safety circuits.

An overspeed detector 116 provides a signal 55-1 which is at the logic one level when there is no overspeed condition. A signal 55-1 at the logic zero level indicates an overspeed condition.

An earthquake detector 118 provides a signal EQ-1 which is at the logic one level when an associated earthquake relay is deenergized, which relay may be responsive to a seismic detector, and/or a counterweight derailment detector. If the earthquake relay is energized, the signal EQ-1 goes to the logic zero level.

Additional devices which may be monitored by the logic circuit are the Fireman's Return Relay (not shown) which includes a contact FEM-1 which is open until a smoke or temperature detector energizes a relay FEM to close contact FEM-1; and, a Hand Operation Relay (not shown) which includes a contact 60H-1 which is open unless the car is placed on hand control by maintenance personnel. A push-button TDS-1 may also be provided, such as at a traffic director's station, which enables the display to be manually switched from the normal mode to the emergency mode, when desired. Contacts FEM-1 and 60H-1, and pushbutton TDS-1 are each connected serially between a source 120 of unidirectional potential and ground 122 via resistors 124, 125 and 126, respectively.

Signals EQ-1, 55-1 and 29-1, as well as contacts FEM-1 and 60H-1 and pushbutton TDS-1 are monitored by logic circuit 101 which includes a NAND gate 127 and an inverter or NOT gate 128. NAND gate 127 has a plurality of inputs, each connected to monitor a different signal, contact, or pushbutton. When all of the functions monitored by NAND gate 127 are normal, all of the inputs to the gate will be at the logic one level and the output EXDIS of NAND gate 127 will be in a first condition, i.e., at the logic zero level. Signal EXDIS is connected to the enable input CE of PROM I. A logic zero input to the enable input CE enables PROM I to operate, which provides the normal display mode. If any input to NAND gate 127 goes low, the output of NAND gate 127 is operated to a second condition, i.e., to a logic one. The logic one disables PROM I. The output of NAND gate 127 is connected to the enable input of PROM II via the inverter 128, to provide a signal $\overline{EXDIS}$ at the enable input CE. Thus, when PROM I is enabled, PROM II is disabled, and vice versa, to select either the first or the second display modes of control 42.

The travel direction signals $\overline{DAU}$ and $\overline{DAD}$ are connected to a display driver 132. In addition to driving a selected one of the directional arrow displays 102 and 104, it may provide a common electrode for the right and left digits of the display 40.

PROM I has eight output terminals 01 through 08, with the first four output terminals 01 through 04 providing a BCD word for the left digit 106 of the display, and outputs 05 through 08 provide a BCD word for the right digit 108 of the display 40. In like manner, PROM II has eight outputs 01 through 08, providing two BCD words for controlling the left and right digits of the display 40. The left digit 106 of the display 40 is provided by a display decoder/driver circuit 140, which converts the BCD input word to select the proper segments *a* through *g* of the left digit for energization. In like manner, a display decoder/driver 142 controls the right digit 108 of display 40 in response to the BCD input word. Thus, outputs 01 through 04 of PROM's I and II are connected to display decoder/driver 140, and outputs 05 through 08 of PROM's I and II are connected to display decoder/driver circuit 142. The input lines to the display decoder/driver circuits 140 and 142 are held high by a +5 volt unidirectional voltage source and associated resistors, indicated generally at 159, until the associated output line from a PROM is driven low. Circuits 132, 140 and 142 are preferably COS/MOS devices for driving liquid crystal displays, such as RCA's CD4054A for circuit 132 and CD4055A for circuits 140 and 142.

A square wave signal DF provided by a square wave generator 144, is applied to each of the display drivers, with a frequency which is in the range of 30 Hz. to 3 KHz., which is above the flicker rate and below the upper limit of the frequency response of the field effect liquid crystal, respectively.

The display decoder/drivers 140 and 142 decode the output of the enabled PROM, i.e., either PROM I or PROM II, to provide a corresponding display notation. For example, if the BCD input word provided by the enabled PROM is 0000, the six output lines of the decoder which correspond to segments *a* through *f* will be 180° out of phase with signal DF and the seventh output line corresponding to segment *g* will be in phase with signal DF, which results in the displaying of the number 0. A truth table for the display decoder/drivers 140 and 142 is shown on page 271 of RCA's Solid State Databook Series, Book SSD203C, 1975 edition.

FIGS. 3 and 4 are charts which illustrate examples of programming for PROM's I and II, respectively, which may be used to provide normal and emergency display notations, respectively. The elevator car 12 shown in FIG. 1 is able to serve floors 1, 20 through 30 and the penthouse PH. In addition, the distance between the first floor and the second floor is assumed to be twice the distance between the remaining floors. In the normal display mode, it would be confusing and unnecessary to display floor numbers when the car is in the express zone, i.e., floors 2 through 19. Thus, as illustrated in FIG. 3, with 7 segment display characters, each character may simply show a "dash" when the car is in the express zone. Further, the display illustrates a "1" while the elevator car is traversing the greater than normal distance from floor 2 to floor 1.

PROM II is programmed as shown in FIG. 4, to more accurately locate the elevator car relative to the floors of the structure, by indicating floor numbers when the elevator car is in the express zone, and to also more accurately indicate the location of the car relative to the first floor by dividing the spacing between the first and second floors into a low zone 1L and a high zone 1H.

This programming is accomplished by providing a car position signal AVP0-AVP4 for each car position desired in the emergency mode. If car positions in the building are indicated by repetitively dividing a predetermined time period into a plurality of time or scan slots, such as in the hereinbefore mentioned U.S. Pat. No. 3,750,850, then the scan counter for providing the scan slots should provide enough scan slots for each car position to be displayed. For example, if a building has 32 floors and no abnormally large spacing between any of the floors, 32 scan slots would be sufficient, with each floor level being associated with a different scan slot. The serial car position would thus appear in one of the scan slots each time the predetermined timing period is scanned by the scan counter. If, for example, it would be desired to more accurately locate the elevator car between each of the floors during an emergency condition, the scan counter for a 32 floor building would have to provide 64 scan slots, with the locations between each pair of adjacent floors being assigned a scan slot.

The charts of FIGS. 3 and 4 illustrate the PROM input in the left column, which are addresses provided by the car position signal AVP0-AVP4 and the next two columns illustrate the first and second BCD output words from the PROMs for selecting the left and right digits of the display. The last column, at the extreme right of the chart illustrates the left and right digits of the display which correspond to the code of the BCD words. As hereinbefore stated, this code may be found in the truth table of the RCA reference book.

In summary, there has been disclosed a new and improved elevator system having a car position indicator which includes first and second display modes associated with normal and emergency elevator conditions, respectively. The first or normal mode displays the position of the car with an accuracy sufficient for normal elevator operation. The second or emergency mode displays the position of the car with an accuracy which quickly locates a car in an express zone, and/or between certain or all of the floors, permitting quick location and evacuation of all cars during an emergency.

Certain modifications may be made to the disclosed implementation of the invention, as the implementation is set forth as illustrative of one of the many embodiments which fall within the scope of the invention. For example, when the invention is used at a traffic director's station, the same PROMs may be used for all cars of a bank of cars by routing the car position data bit signals from each car to the PROMs on a "time shared" basis.

Also, when the display switches to the emergency mode, a signal FLASH may be developed to cause the display at a traffic director's station to flash the car position on and off.

As hereinbefore stated, the invention may also be used with a relay system floor selector by adding an extra selector contact for each additional car position desired during the emergency mode. The contact closures of the selector would be connected to a diode matrix to convert each car position into an equivalent 5 bit binary signal, which signal would then be connected to PROM I and PROM II. Further, the PROMs may be eliminated by using a diode matrix sized according to the number of segments in the display character. For example, if the display character has 15 segments, a 32 $\times$ 30 diode matrix may be used, with the 30 rows of the matrix being directly connected to the CD4054A liquid crystal drivers. 15 rows would be used for selection of the left digit segments, and 15 rows for the right digit segments.

While the car position indicator PI has been described and illustrated with an elevator system of the traction type, it is to be understood that it may be utilized with any elevator system, such as an elevator system of the hydraulic type.

I claim as my invention:

1. An elevator system, comprising:

a structure having a plurality of floors, an elevator car mounted in said structure to serve at least certain of the floors, first means providing a first signal indicative of the location of said elevator car in said structure, second means operable between first and second conditions, display means, and control means for driving said display means, said control means being responsive to said first and second means, said control means providing signals for said display means which cause said display means to indicate the location of the elevator car in the structure in response to both the first and second conditions of said second means, with the indicated location of the elevator car being more specific with respect to at least one of the floors when said second means is in its second condition than when it is in its first condition.

2. An elevator system, comprising:

a structure having a plurality of floors, an elevator car mounted in said structure to serve at least certain of the floors, said structure including at least one floor which the elevator car is not enabled to serve, first means providing a first signal indicative of the location of said elevator car in said structure, second means operable between first and second conditions, display means, and control means for driving said display means, said control means being responsive to said first and second means, said control means providing signals for said display means which cause said display means to more accurately indicate the location of the elevator car in the structure when said second means is in its second condition than when it is in its first condition, with the signals provided by the control means for the display means specifically identifying when the elevator car is adjacent said at least one floor only when the second means is in its second condition.

3. An elevator system, comprising:

a structure having a plurality of floors, an elevator car mounted in said structure to serve at least certain of the floors, said structure including a zone of floors which the elevator car is not enabled to serve, first means providing a first signal indicative of the location of said elevator car in said structure, second means operable between first and second conditions, display means, and control means for driving said display means, said control means being responsive to said first and second means, said control means providing signals for said display means which cause said display means to more accurately indicate the location of the elevator car in the structure when said second means is in its second condition than when it is in its first condition, with the signals provided by the control means for the display means specifically identifying the floors of said zone, when the elevator car is in the zone, only when the second means is in its second condition.

4. An elevator system, comprising:

a structure having a plurality of floors, an elevator car mounted in said structure to serve at least certain of the floors, first means providing a first signal indicative of the location of said elevator car in said structure, said first means identifying the location of the elevator car relative to at least one of the floors with first and second different signals to indicate first and second different locations of the elevator car relative to this floor, second means operable between first and second conditions, display means, and control means for driving said display means said control means being responsive to said first and second means, said control means providing signals for said display means which cause said display means to more accurately indicate the location of the elevator car in the structure when said second means is in its second condition than when it is in its first condition, with said control means identifying only the first location relative to said at least one floor when the second means is in its first condition, and identifying the first and second locations, when the elevator car is in said first and second locations, respectively, when the second means is in its second condition.

5. The elevator system of claim 1 wherein the first signal provided by said first means is a binary address, and the control means includes memory means which decodes at least certain of the binary addresses differently, depending upon the condition of said second means.

6. An elevator system, comprising:

a structure having a plurality of floors, an elevator car mounted in said structure to serve at least certain of the floors, first means providing a first signal indicative of the location of said elevator car in said structure, said first means providing at least two different first signals relative to at least one of the floors, second means operable between first and second conditions, display means, and control means for driving said display means, said control means being responsive to said first and second means, said control means providing signals for said display means which cause said display means to more accurately indicate the location of the elevator car in the structure when said second means is in its second condition than when it is in its first condition, with the control means providing the same signal for the display means in response to each of said at least two different signals when the second means is in its first condition, and different signals for the display means when the second means is in its second condition.

7. The elevator system of claim 1 wherein the second means is normally in its first condition, and including means for automatically operating the second means to its second condition in response to a predetermined condition.

8. The elevator system of claim 7 wherein the predetermined condition is disablement of the elevator car.

9. The elevator system of claim 1 including monitoring means for monitoring a predetermined condition, and for stopping the elevator car in the event said predetermined condition occurs, and wherein the second means is responsive to said monitoring means, switching from its first condition to its second condition in the event said monitoring means stops the elevator car.

10. The elevator system of claim 1 wherein the structure includes a zone of floors which the elevator car is not enabled to serve, and including means responsive to the stopping of the elevator car in said zone for operating the second means from its first to its second condition, and wherein the control means provides signals for the display means when the elevator car is in said zone which indicates only that the elevator car is in said zone when the second means is in its first condition, and which identifies the location of the elevator car in the zone relative to a floor when the second means is in its second condition.

* * * * *